US011140958B1

(12) United States Patent
Baldwin

(10) Patent No.: US 11,140,958 B1
(45) Date of Patent: Oct. 12, 2021

(54) TRAVEL SUITCASE

(71) Applicant: Robert Baldwin, Smyrna, GA (US)

(72) Inventor: Robert Baldwin, Smyrna, GA (US)

( * ) Notice: Subject to any disclaimer, the term of this patent is extended or adjusted under 35 U.S.C. 154(b) by 463 days.

(21) Appl. No.: 16/239,650

(22) Filed: Jan. 4, 2019

(51) Int. Cl.

| | |
|---|---|
| ***A45C 13/00*** | (2006.01) |
| ***A45C 5/14*** | (2006.01) |
| ***A45C 13/22*** | (2006.01) |
| ***A45C 11/00*** | (2006.01) |
| ***A45C 5/03*** | (2006.01) |

(52) U.S. Cl.
CPC ..... *A45C 13/001* (2013.01); *A45C 5/03* (2013.01); *A45C 5/146* (2013.01); *A45C 11/00* (2013.01); *A45C 13/22* (2013.01); *A45C 2011/003* (2013.01); *A45C 2013/226* (2013.01)

(58) Field of Classification Search
CPC ..... A45C 13/001; A45C 5/03; A45C 5/146; A45C 11/00; A45C 13/22; A45C 2011/003; A45C 2013/226
See application file for complete search history.

(56) References Cited

U.S. PATENT DOCUMENTS

| | | | | |
|---|---|---|---|---|
| 6,398,594 | B1 * | 6/2002 | Bonilla | H01R 13/506 439/107 |
| 6,471,019 | B1 | 10/2002 | Miller | |
| 6,811,006 | B1 | 11/2004 | Mundle | |
| 9,144,281 | B2 * | 9/2015 | Cross | A45C 15/00 |
| 9,918,546 | B2 * | 3/2018 | Smith | A45C 13/28 |
| 10,595,608 | B2 * | 3/2020 | Korey | A45C 15/00 |
| 10,674,799 | B2 * | 6/2020 | Shalgi | A45C 13/262 |
| 2011/0209960 | A1 * | 9/2011 | MacLean, III | A45C 15/00 190/18 A |
| 2013/0032443 | A1 * | 2/2013 | Soedomo | A45C 15/00 190/11 |
| 2013/0186723 | A1 * | 7/2013 | D'Angelo | A45C 5/146 190/18 A |
| 2015/0027836 | A1 * | 1/2015 | Zhou | A45C 5/14 190/12 A |
| 2016/0081469 | A1 * | 3/2016 | Undesser | A45C 13/28 108/41 |
| 2019/0069659 | A1 * | 3/2019 | Van Loon | A45C 9/00 |

* cited by examiner

*Primary Examiner* — Tri M Mai
(74) *Attorney, Agent, or Firm* — Sanchelima & Associates PA; Christian Sanchelima; Jesus Sanchelima

(57) ABSTRACT

The present invention is a travel suitcase that is easily deployed to be used as a table for supporting electronic devices charging thereof. Travel suitcase includes a swiveled tray, securing element, pair of telescopic legs and charging unit. Swiveled tray is connected to travel suitcase by a swivel connection that swivels swiveled tray between a first and second positions. Securing element secures swiveled tray in its in-operative configuration at first position. Telescopic legs extend out to reach the ground to support swiveled tray in second position so that swiveled tray is usable as a table. Charging unit has a removable frame that houses a power storage battery and charging socket with at least one three-pin port and USB charging port to charge various devices. Travel suitcase is further provided with a telescopic wheel adjuster for front and/or rear wheels to displace travel suitcase steadily with stability and without much tumbling.

14 Claims, 8 Drawing Sheets

TRAVEL SUITCASE

BACKGROUND OF THE INVENTION

1. Field of the Invention

The present disclosure relates to a suitcase used for travelling. More particularly, the present disclosure relates to a rolling travel suitcase with a table, charging port and a wheel adjuster.

2. Description of the Related Art

With the advancement in technologies, it is easy to connect to work or entertainment by using various devices, such as laptops and mobile phones, during travel. However, when these devices get discharged it becomes difficult to find the desired charging ports. Also, the positioning of a laptop on user's lap is inconvenient. Hence, there is a need for a travel suitcase that is deployed to be used as a table and is able to charge various devices. As most of the travel suitcases have rolling wheels, when travel suitcases are ported with an additional luggage positioned on handles, travel suitcases experiences tumbling. Hence, there is a need for a travel suitcase which experiences reduced tumbling.

Several designs for travel suitcases have been designed in the past. None of them, however, includes a travel suitcase that has wheel adjustments for stable displacement, easily deployed to be used as a table and facilitates power charging of various devices.

Applicant believes that a related reference corresponds to U.S. Pat. No. 6,811,006 filed by Adrian Mundle for a convertible briefcase/table. The Jonie reference discloses a new convertible briefcase/table for providing a user carrying a briefcase with a convenient work table. However, the convertible briefcase/table does not provide power charging port nor explicitly mentions about the stability of suitcase during displacement.

Another related application is U.S. Pat. No. 6,471,019 filed by Travelpro International Inc. for a travel case with deployable table. The patent '019 discloses a travel case which includes a deployable tray table mounted to the housing. However, patent '019 is silent on the feature of providing power charging port and stability of suitcase during displacement.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a travel suitcase that is deployed to facilitate placing of electronic devices thereon to provide convenience to user for operation during travel.

It is an object of the present invention to provide a travel suitcase that includes a power charging unit for power charging of various electronic devices and easily attachable and detachable with travel suitcase.

It is an object of the present invention to provide a travel suitcase that includes a telescopic wheel adjuster to adjust length of front wheels and/or rear wheels of travel suitcase for stable displacement of travel suitcase.

It is an object of the present invention to provide a travel suitcase that includes a swiveled tray that is extendable to hold different types of objects such as electronic devices, food, beverages, books or small pouches.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
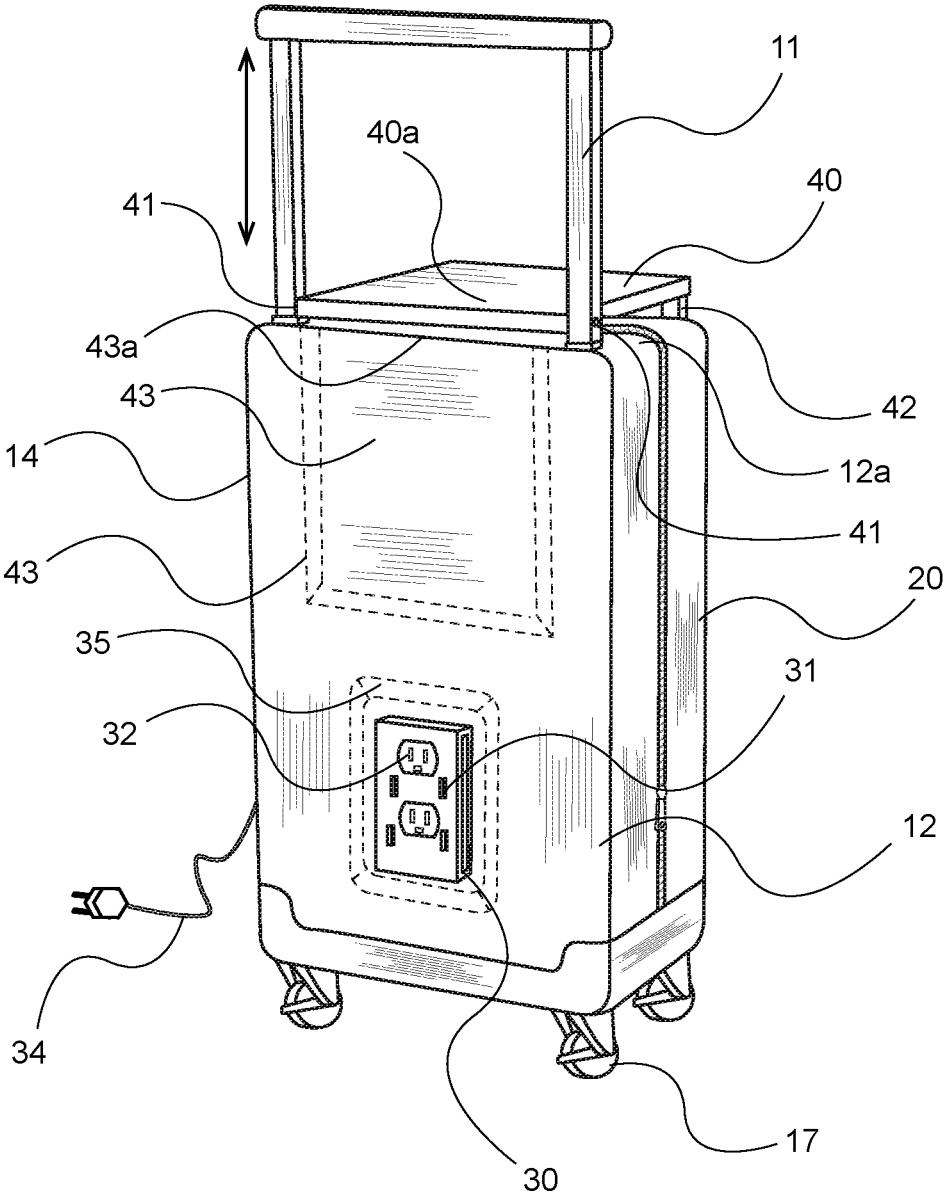
FIG. 1 represents an isometric back view of a travel suitcase 10, in accordance with one embodiment of the present invention. The travel suitcase 10 includes a swiveled tray 40 in an unfolded configuration that acts as a table and a charging socket 30.

The present disclosure discloses a travel suitcase that along with storing various articles, such as clothing or accessories, is also used as a table for mounting electronic devices, such as laptops or tablets, by deploying a swiveled tray. Swiveled tray is extendable to support various objects like food packets, beverages, bottles, cans, books and the like. Further, travel suitcase also has a power charging unit having a charging socket configured with various types of charging port to charging various electronic devices, such as laptop, tablets or mobile, during travel and hence prevents the need to search for desired charging port. Power charging unit includes a frame that houses a power storage battery and a charging socket and frame is easily detachable from the travel suitcase so that travel suitcase can be examined for security checks at airports or other stations. Once examined, frame is easily attached to travel suitcase. Furthermore, the travel suitcase is featured with a telescopic wheel adjuster for adjusting front wheels and/or rear wheels so that the travel suitcase is displaced stably and experiences less tumbling especially when an additional luggage is positioned on the travel suitcase.

Referring now to the drawings, FIGS. 1-6, where the present invention is generally referred to with numeral 10, it can be observed that a travel suitcase, in accordance with one embodiment, is provided that includes a swivel connection 41, a swiveled tray 40, a securing element, a pair of telescopic legs 42 and a charging unit. Travel suitcase 10 is defined with a front portion 19, a back portion 12, a side portion 18 formed by extending front portion 19 and back portion 12, a longitudinal side portions 14 and 20. Front portion 19 can be optionally provided with at least one storage compartment 19*a*.

Swivel connection 41 connects swiveled tray 40 with a handle 11 of suitcase 10 such that swiveled tray 40 swivels about handle 11. In depicted example, handle 11 is slideable up and down at back portion 12*a* of suitcase 10 and swiveled tray 40 also slides up and down when handle 11 slides up and down respectively.

Figure 2:
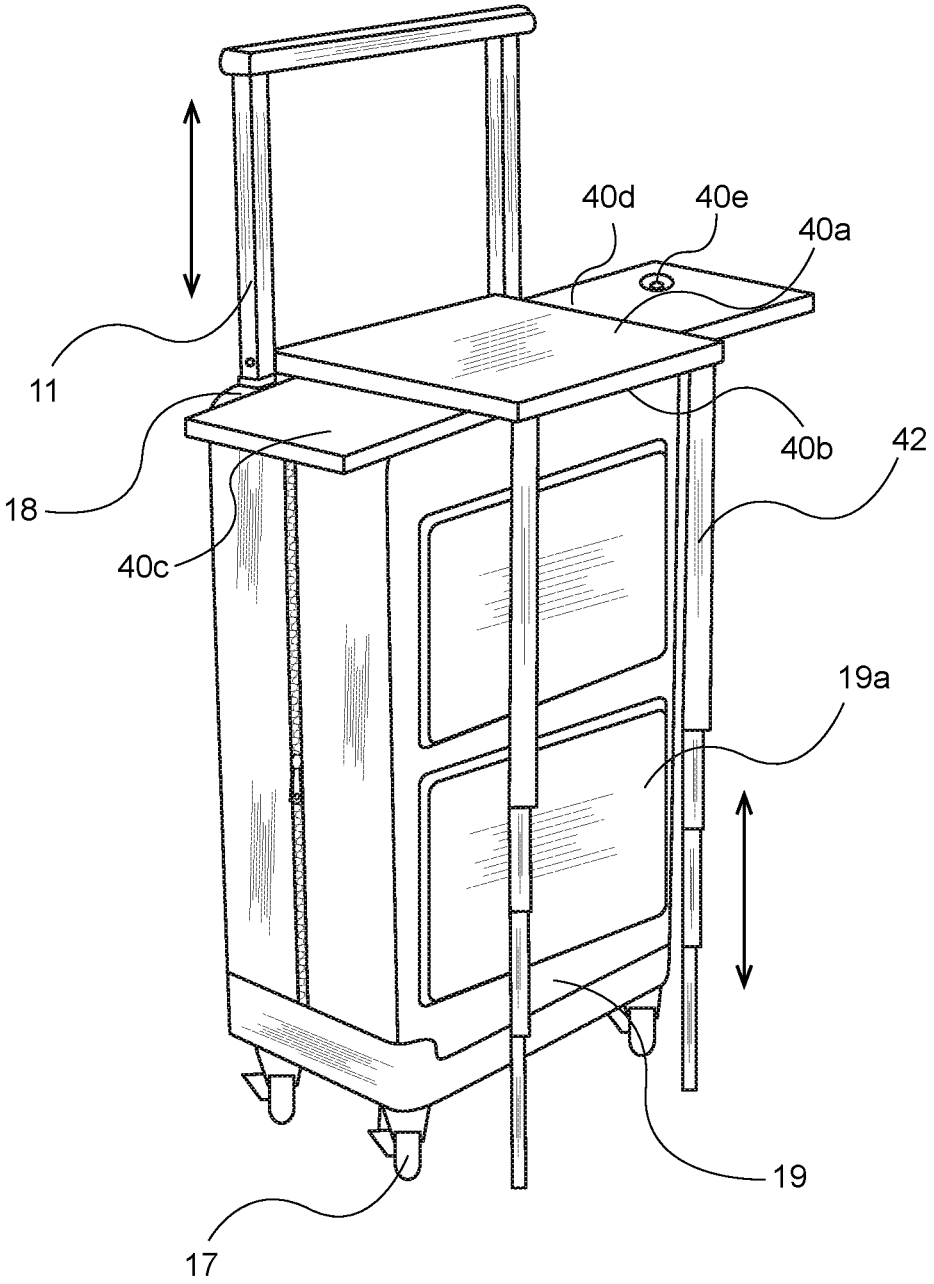
FIG. 2 demonstrates another isometric view of a front view of the travel suitcase 10. The swiveled tray 40 is supported by telescopic legs 42 that are in extended configuration and resting on the ground.
Figure 3:
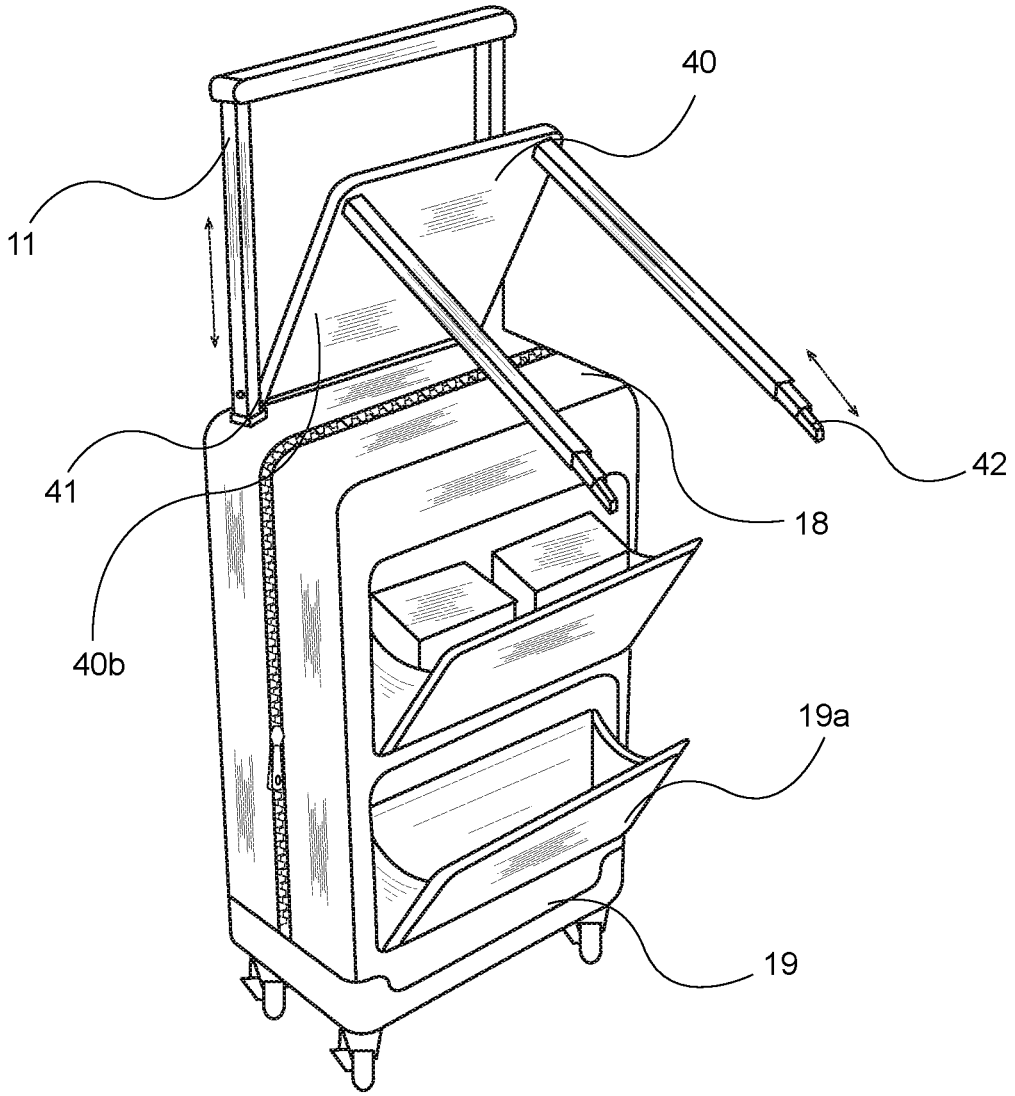
FIG. 3 shows an isometric view of travel suitcase 10 in which the telescopic legs 42 are extending to achieve the extended configuration.
Figure 4:
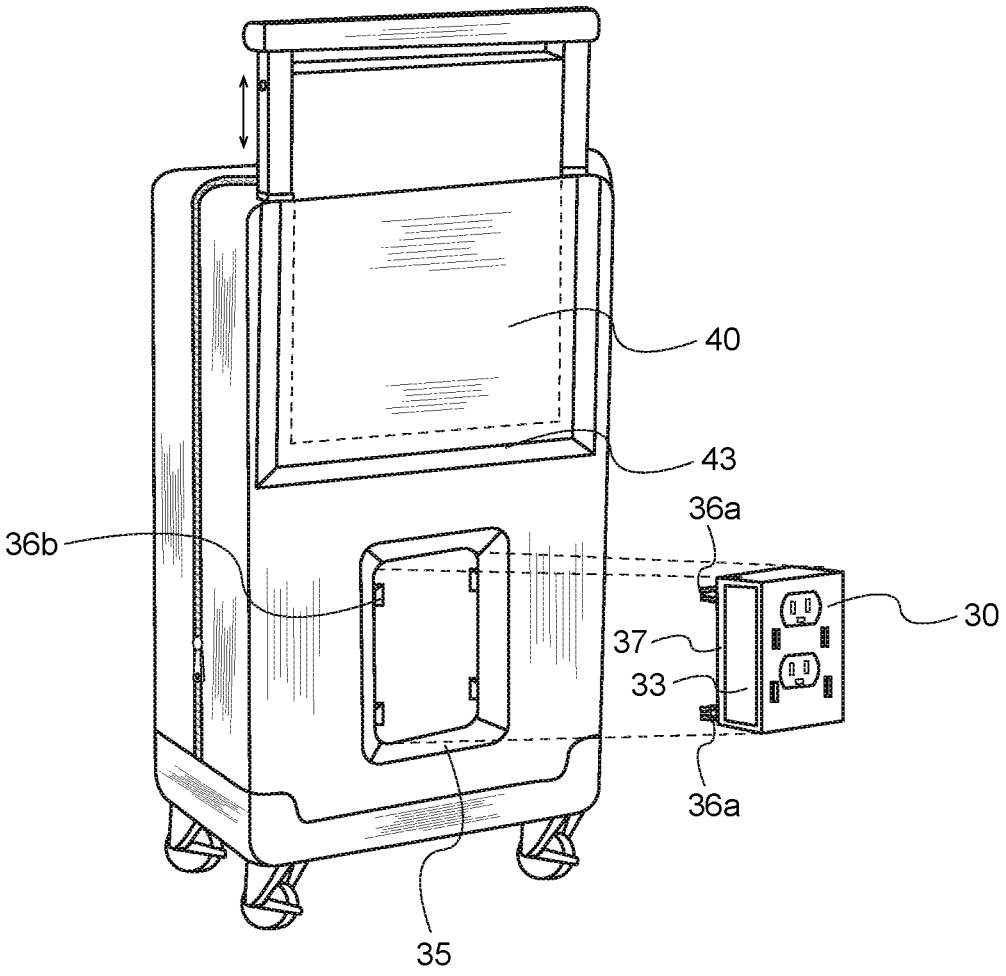
FIG. 4 is an exploded view of a frame 37 and a cavity 35 configured on back portion 12 of travel suitcase 10 and table 40 partially inserted in securing element 43.
Figure 5:
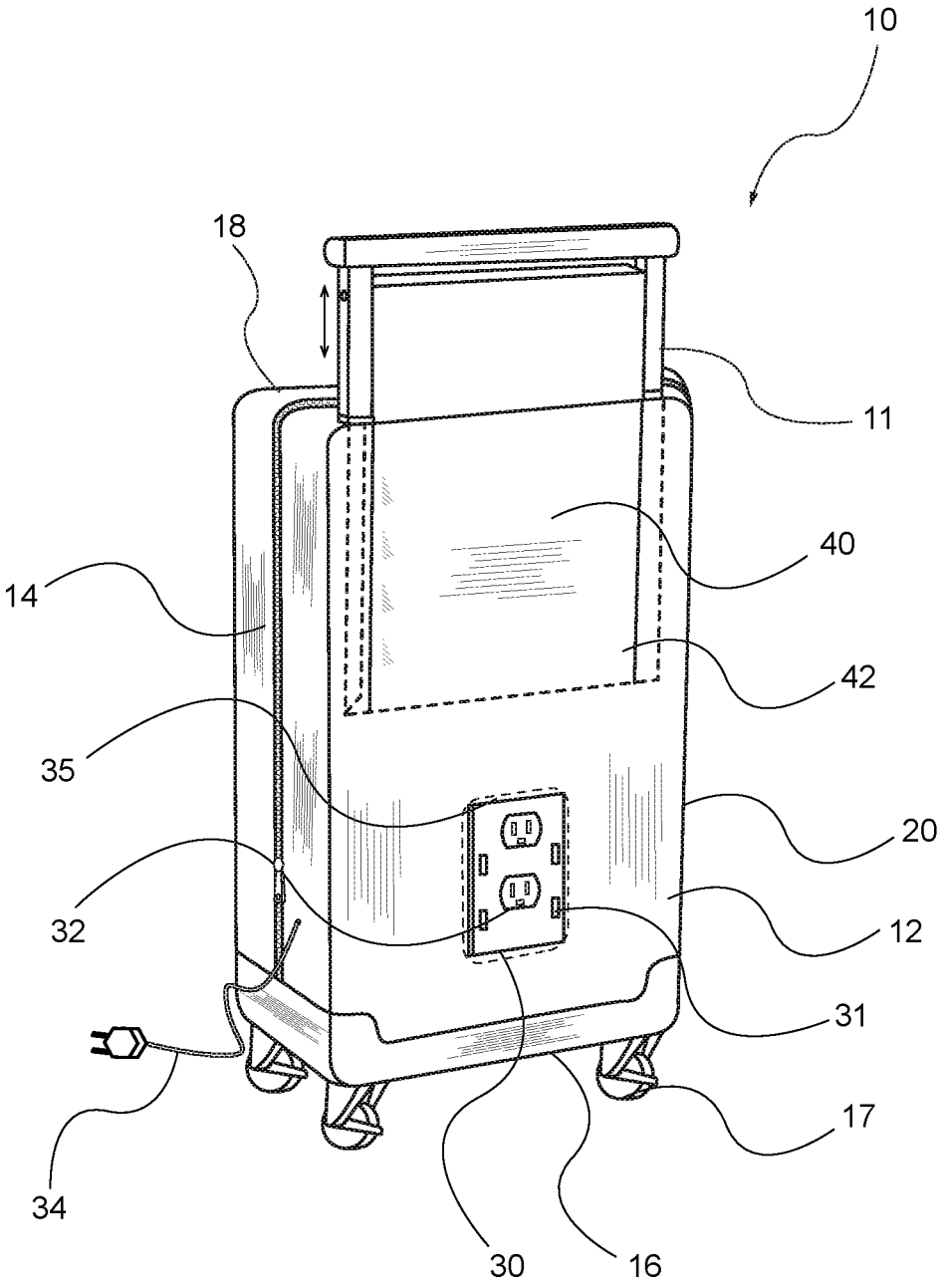
FIG. 5 is a perspective view of travel suitcase 10 in which the swiveled tray 40 is in a closed configuration.
Figure 6:
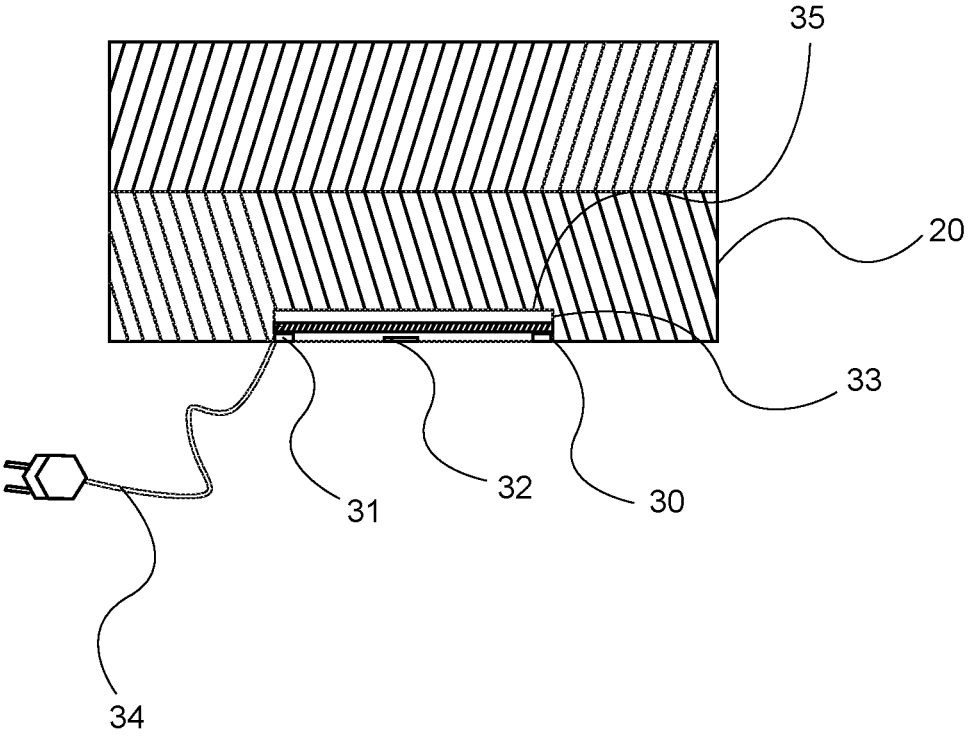
FIG. 6 is a sectional top view of travel suitcase 10 which depicts a battery 33 connected to the charging socket 30.

Swiveled tray 40 is connected to swivel connection 41 so that swiveled tray 40 is swiveled from a first position (as illustrated in FIGS. 1 and 2) to a second position (as illustrated in FIGS. 4 and 5) and vice-versa by swiveling about handle 11. Swiveled tray 40 is defined with a top flat surface 40*a* and a bottom receptacle 40*b*. Swiveled tray 40 is provided with at least one extended portion(s) 40*c* and/or 40*d* and one or both extended portion(s) has at least one blind slot/indent 40*e* that can hold bottles, cans, glasses and the like.

Securing element is disposed at the back portion 12 to secure swiveled element 40. Moreover, as depicted securing element is a cavity 43 provided at the back portion 12 of travel suitcase 10. Cavity 43 can either be configured in the internal portion of travel suitcase 10 or can be a housing formed of a flap with a receiving end 43*a* to receive swiveled tray 40. Alternatively, securing element can be a locking mechanism (not illustrated in Figures) such as a foldable bracket.

Telescopic legs 42 are in hinged connection with bottom receptacle 40*b* of the swiveled tray 40. When in a retracted configuration, telescopic legs 42 are completely seated in bottom receptacle 40*b*. Telescopic legs 42 when completely seated in bottom receptacle 40*b* define an in-operative configuration. When in an extended configuration, telescopic legs 42 extend out to reach the ground to support swiveled tray 40. Telescopic legs 42 when completely extended to reach the ground and support swiveled tray 40 define an operative configuration.

In operation, when a user needs a table, handle 11 is lifted and swiveled tray 40 and is swiveled around to be seated on the side portion 18. Telescopic legs 42 are then swiveled from the hinge and extended to reach the ground to support swiveled tray 40. Thus, swiveled tray 40 acts as a table and user can conveniently position an electronic device (not illustrated in Figures) on top flat surface 40*a*. Table can also be extended to keep eatable and/or drinks.

Charging unit is disposed on back portion 12 of travel suitcase 10. However, charging unit can be positioned on any portion of the suitcase 10 and not limited to positioning on the back portion 12. Charging unit includes a removable frame 37 that supports a power storage battery 33 and a charging socket 30 which is in connection with storage battery 33 and encloses frame 37. Removable frame 37 is attachable and detachable in a cavity 35 configured in back portion 12 of travel suitcase 10 by use of fixing elements. Fixing elements can be lock inserts 36*a* disposed on frame 37 and holes 36*b* configured in cavity 35. Lock inserts 36*a* are press locks that when pressed are removed out from holes 36*b* and when inserted in holes 36*b* are locked. Alternatively, fixing elements can also be sliding frames that inserts and removes frame 37 by sliding. Other fixing elements are within the scope of disclosure that easily attaches and detaches frame 37 from cavity 35. Power storage battery 33 can be rechargeable battery or can be replaced by other power storage batteries. When rechargeable, power storage battery 33 can be charged with a charging pin 34 connected with any charging port. Charging socket 30 is defined with at least one three-pin port 32 to receive at least one three-pin charger/adaptor, typically of a laptop or tablet. Further, charging socket 30 includes at least one Universal Serial Bus (USB) charging port 31 to insert a USB wire, typically of a hand-held device such as mobile phones. Thus, at a particular instant, user can charge multiple electronic devices at a particular time such as a laptop and a mobile phone.

Figure 7:
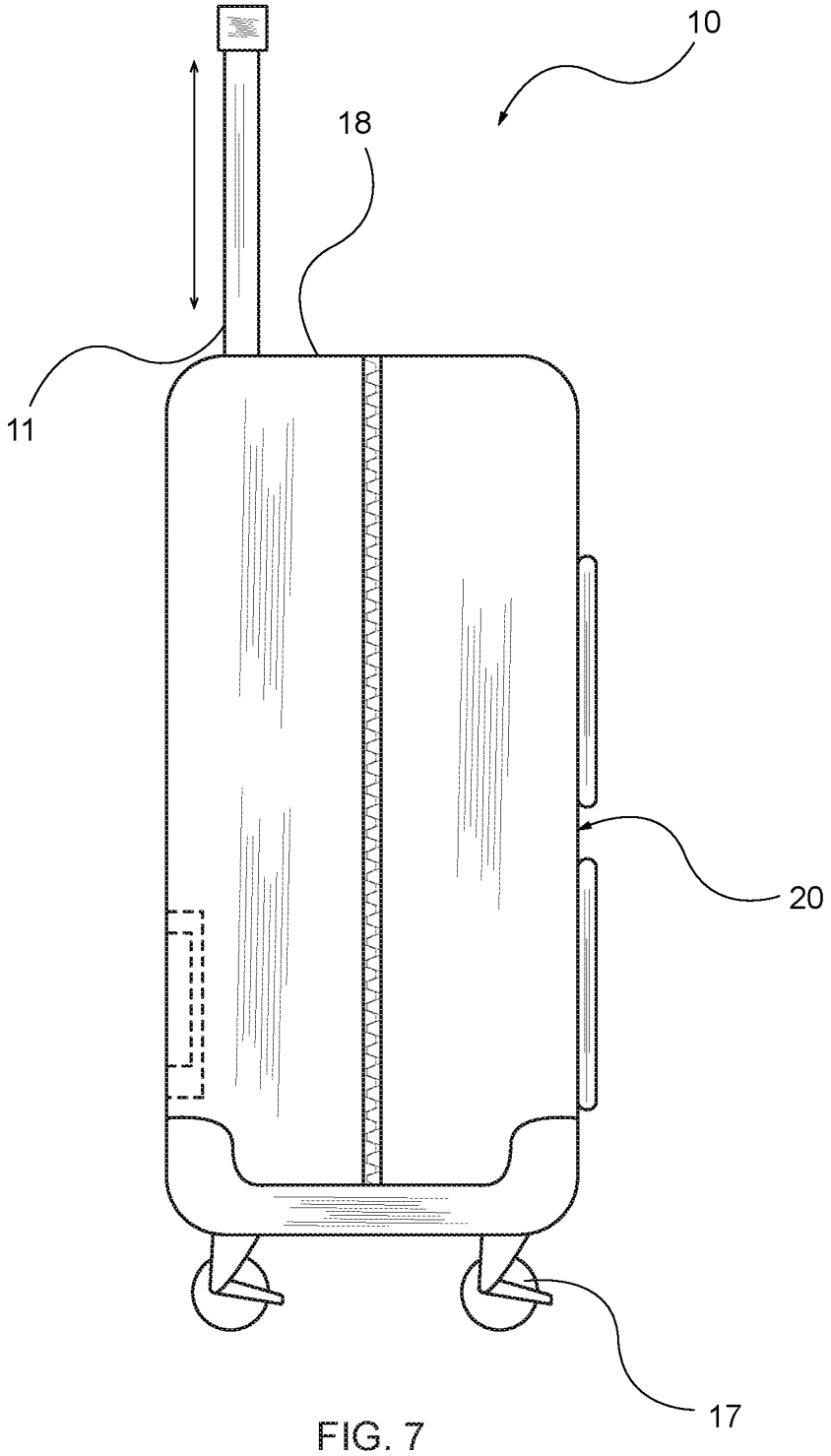
FIG. 7 represents a side view of the travel suitcase 10 in which back wheels are in retracted configuration.
Figure 8:
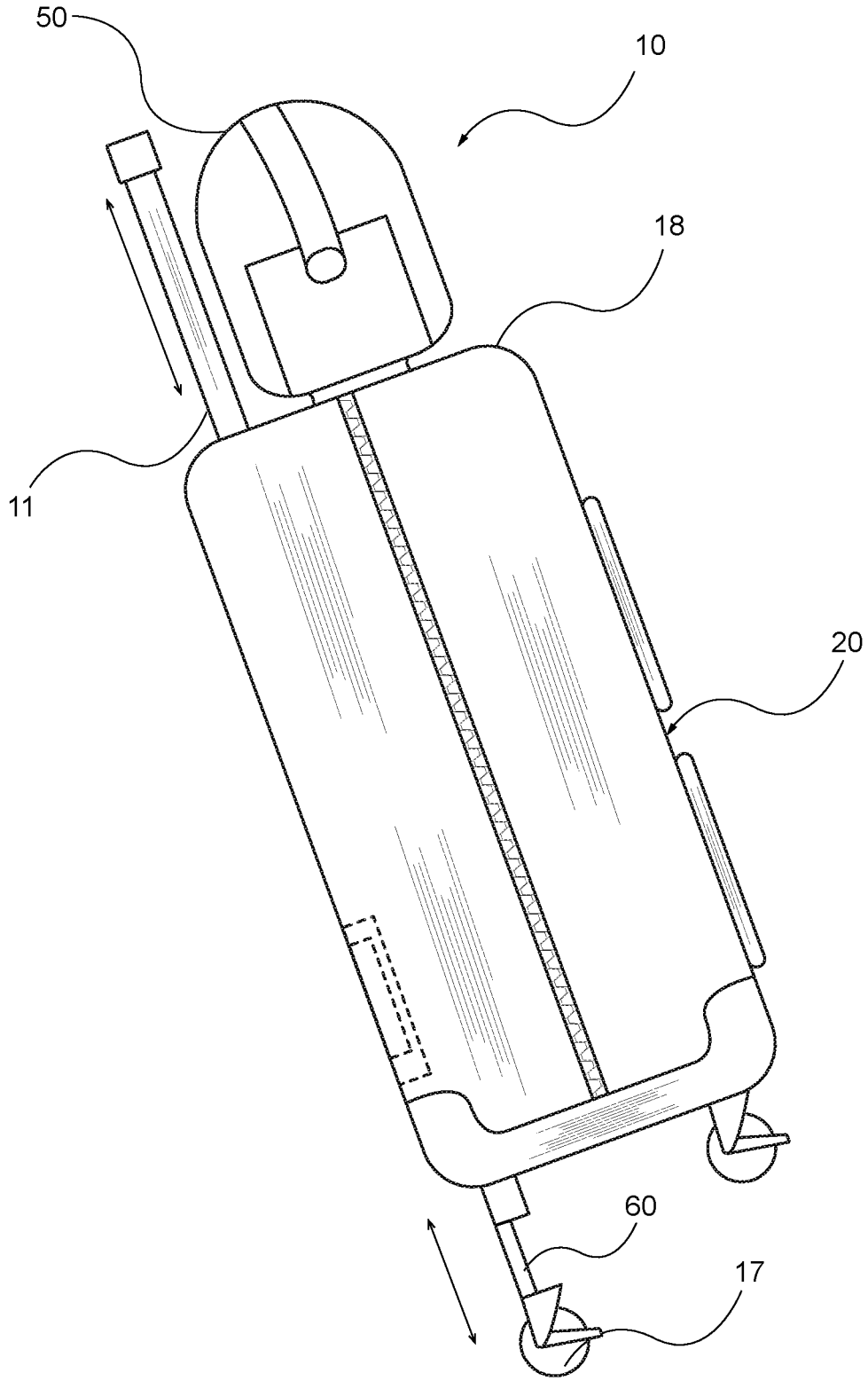
FIG. 8 represents a side view of the travel suitcase 10 in which back wheels 17 are in extended configuration by telescopic wheel adjuster to achieve stability.

Referring now to the drawings, FIGS. 7-8, travel suitcase 10 is optionally provided with a telescopic wheel adjuster 60 for front wheels and/or rear wheels 17 of the suitcase 10. Telescopic wheel adjuster 60 extends and retracts front wheels and/or rear wheels 17 of suitcase 10. Typically, telescopic wheel adjuster 60 adjusts front and/rear wheels 17 in three incremental heights and three decremental heights from the original height. Each increment and/or decrement of height is approximately about ½ inch. In operation, when an additional luggage bag 50 is positioned on side portion 18 and handle 11 and when travel suitcase 10 is pulled to be displace to various locations, telescopic wheel adjuster 60 are adjusted to extend and retract front wheels and/or rear wheels 17 so that travel suitcase 10 displaces steadily with stability and without much experiencing tumbling of travel suitcase 10. In one embodiment, telescopic wheel adjuster 60 can be adjusted up to three length adjustments. The adjustment can be manually done or by use of a mechanical mechanism (not illustrated in Figures) provided with a push button (not illustrated in Figures) to actuate the mechanical mechanism. The mechanical mechanism can be a pull-rod mechanism.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A travel suitcase defined with a front portion, a back portion, the front and the back portions extended to form a side portion, the extended back portion provided with a telescopic handle, said suitcase comprising:

a. a swivel connection disposed at an extended back portion;

b. a swiveled tray in connection with said swivel connection and configured to selectively swivel between a first position and a second position, said swiveled tray defined with a top flat surface and a bottom receptacle;

c. a securing element disposed at said back portion to secure swiveled element being in said first position;

d. a pair of telescopic legs in a retracted configuration seated in said bottom receptacle and in an extended configuration extend out to reach the ground to support said swiveled tray being in said second position; and e. a charging unit defined with:

i. a frame selectively attachable and detachable with a cavity configured on a portion of the travel suitcase;

ii. a power storage battery disposed in said frame; and iii. a charging socket enclosing said power storage battery within the travel suitcase, said charging socket defined to receive at least one three-pin port to receive a three-pin charger/adaptor and at least one Universal Serial Bus (USB) charging port for receiving USB cable.

2. The suitcase as claimed in claim 1, wherein said securing element is a housing.

3. The suitcase as claimed in claim 1, wherein said securing element is a locking mechanism.

4. The suitcase as claimed in claim 1, wherein said top flat surface of said swiveled tray is selectively positioned with a laptop.

5. The suitcase as claimed in claim 1, further comprises a telescopic wheel adjuster that extends and retracts front wheels and/or rear wheels of the suitcase.

6. The suitcase as claimed in claim 1, wherein said charging unit is positioned on the back portion.

7. The suitcase as claimed in claim 1, wherein said swiveled tray having at least one extended portion.

8. The suitcase as claimed in claim 7, wherein said extended portion is configured with at least one blind slot/indent.

9. A travel suitcase defined with a front portion, a back portion, the front and the back portions extended to form a side portion, the extended back portion provided with telescopic handle, said suitcase comprising:

a. a swivel connection disposed on the telescopic handle;

b. a swiveled tray in connection with said swivel connection and configured to selectively swivel between a first position and a second position, said swivel tray defined with a top flat portion and a bottom receptacle, wherein, said swiveled tray has at least one extended portion and at least one of extended portion is provided with a blind slot;

c. a securing element disposed at said back portion to secure swiveled element being in said first position;

d. a pair of telescopic legs in a retracted configuration fitted in said bottom receptacle and in an extended configuration extend out to reach the ground to support said swiveled tray being in said second position;

e. a charging unit defined with:

i. a frame selectively attachable and detachable with a cavity configured on a portion of the travel suitcase;

ii. a power storage battery; and iii. a charging socket enclosing said power storage battery within the travel suitcase, said charging socket defined to receive at least one three-pin port to receive a three-pin charger/adaptor and at least one Universal Serial Bus (USB) charging port for receiving USB cable; and f. a telescopic wheel adjuster that extends and retracts front wheels and/or rear wheels of suitcase.

10. The suitcase as claimed in claim 9, wherein said securing element is a housing.

11. The suitcase as claimed in claim 9, wherein said securing element is a locking mechanism.

12. The suitcase as claimed in claim 9, wherein said top flat portion of said swiveled tray is selectively positioned with a laptop.

13. The suitcase as claimed in claim 9, wherein said side portion is disposed with an additional luggage bag.

14. The suitcase as claimed in claim 9, wherein said charging unit is positioned on the back portion.

* * * * *